US006086421A

United States Patent [19]

Wu et al.

[11] Patent Number: 6,086,421

[45] Date of Patent: Jul. 11, 2000

[54] ELECTRICAL CONNECTOR WITH ONE-PIECE SHIELD

[75] Inventors: Ku Tsan Wu, Tu-Chen; Song-Rong Chiou, Lin-Kou Hsiang, both of Taiwan

[73] Assignee: Hon Hai Precision Inc. Co., Ltd., Taipei Hsien, Taiwan

[21] Appl. No.: 09/218,737

[22] Filed: Dec. 22, 1998

[30] Foreign Application Priority Data

Jul. 14, 1998 [TW] Taiwan ..... 87211270

[51] Int. Cl.[7] ..... H01R 13/648

[52] U.S. Cl. ..... 439/607

[58] Field of Search ..... 439/607, 608, 439/609, 610, 108

[56] References Cited

U.S. PATENT DOCUMENTS 5,083,945 1/1992 Miskin ..... 439/607

5,700,164 12/1997 Weidler ..... 439/607

5,718,606 2/1998 Rigby et al. ..... 439/608

5,738,544 4/1998 Davis ..... 439/607

*Primary Examiner*—Gary F. Paumen

*Assistant Examiner*—Alexander Gilman

*Attorney, Agent, or Firm*—Wei Te Chung

[57] ABSTRACT

A shielded electrical connector including a one-piece shield which is subsequently bent to assume a desired formation and retains this formation by a pair of hooks and corresponding holes thereof. An insulative housing is then inserted into the shield. The hooks and the holes lie at a same side as defined by a pair of opposing junction sections of the conductive shield. The holes are formed on a flange of a limited width, making the engagement between the hooks and the holes firm and reliable.

1 Claim, 4 Drawing Sheets

ELECTRICAL CONNECTOR WITH ONE-PIECE SHIELD

BACKGROUND OF THE INVENTION

The present invention relates to a shielded electrical connector, and, more particularly, to a shielded electrical connector constructed with an insulative housing and a conductive shield encircling the housing.

An electrical connector constructed with conductive contacts within an insulative housing and a conductive shield encircling the housing demands that the housing and the shield remain in fixed positions relative to each other, particularly during mating connection with another mating connector. The housing and the shield are separate parts that are assembled together. A cooperating latching system on the housing and the shield secures the separate parts together. The parts may vary in size as the result of their being manufactured within allowable dimensional tolerances, and when the parts are assembled and latched to each other, their positions can vary due to variations in the sizes of the parts that latch together.

The conductive shields are generally made of two equal or unequal halves or are of a one-piece construction. In the former case, more manufacturing steps and more accurate control over assembling operations are involved. In the latter case, complicate stamping operations for forming protrusions out of the plane of metal sheet are required in order that the protrusions may then be suitably engaged with holes formed on the metal sheet by subsequent bending operation. A need exists for a feature on an electrical connector whose shield can be easily made as well as can be conveniently assembled to and accurately engaged with the housing.

BRIEF SUMMARY OF THE INVENTION

One object of the present invention is to provide an electrical connector which can be easily made and reliably enclosing over an insulative housing.

In accordance with the present invention, the electrical connector comprises:

- an insulative housing having first, second, third and fourth sides and a front face;
- a plurality of contacts secured in the insulative housing; and
- a one-piece conductive shield having a base section covering the first side, a pair of proximal side sections covering the second and third sides, a pair of opposite junction sections continuing the pair of side sections and covering the fourth side, and a front face section covering and the front face of the insulative housing, each junction section having a hook and the face section having a flange, the flange having a pair of holes each for lockingly receiving a corresponding hook of the junction section; and
- means for preventing a rearward movement of the insulative housing relative to the conductive shield.

Other objects, advantages and novel features of the invention will become more apparent from the following detailed description when taken in conjunction with the accompanying drawings.

DETAILED DESCRIPTION OF THE INVENTION

Figure 1:
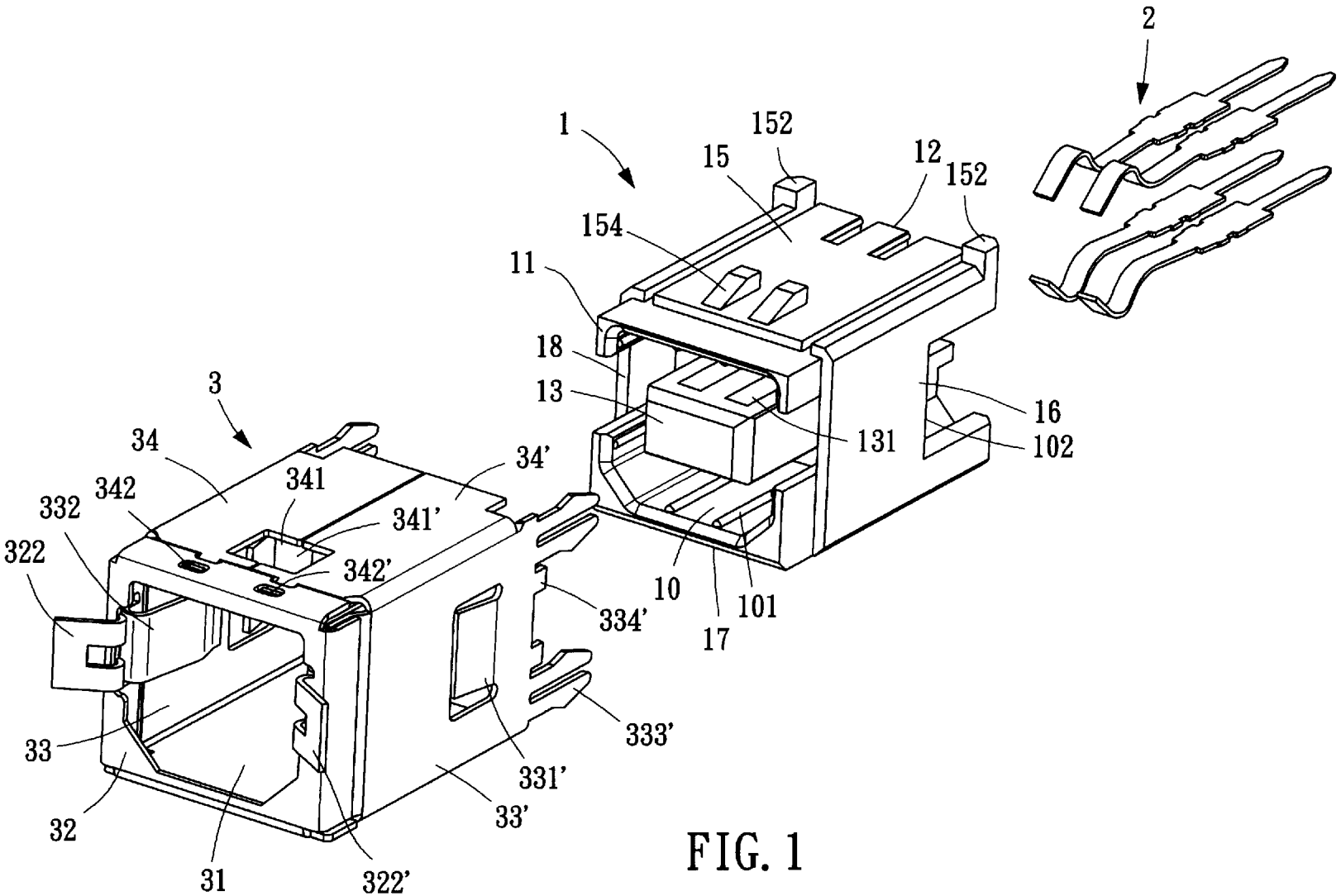
FIG. 1 is an exploded perspective view of an electrical connector in accordance with the present invention.
Figure 2:
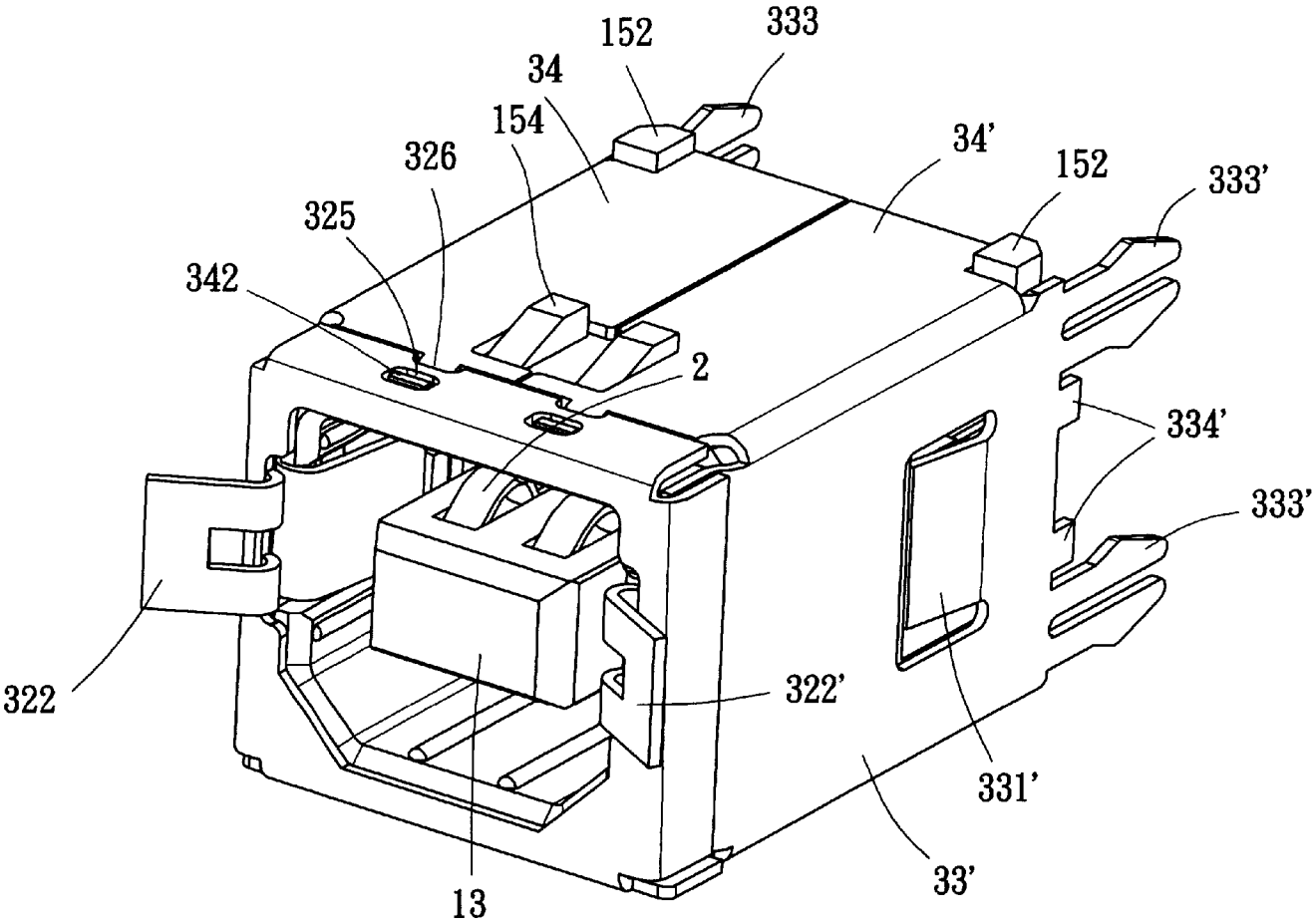
FIG. 2 is an assembled perspective view of the electrical connector of FIG. 1.

Referring now to the drawings and initially to FIGS. 1 and 2, an electrical connector is shown to comprise an insulative housing 1, a plurality of contacts 2 to be secured in the insulative housing 1, and a one-piece conductive shield 3 for circling the insulative housing. The housing 1 has four sides 15, 16, 17 and 18 and front and rear faces 11 and 12, with a cavity 10 defined thereby. A central mating piece 13 having contact-receiving channels 131 on opposite sides thereof extends forward. Guiding ribs, such as identified by reference numeral 101, are provided on interior walls of the cavity 10 for a stable insertion of a mating connector (not shown).

Figure 3:
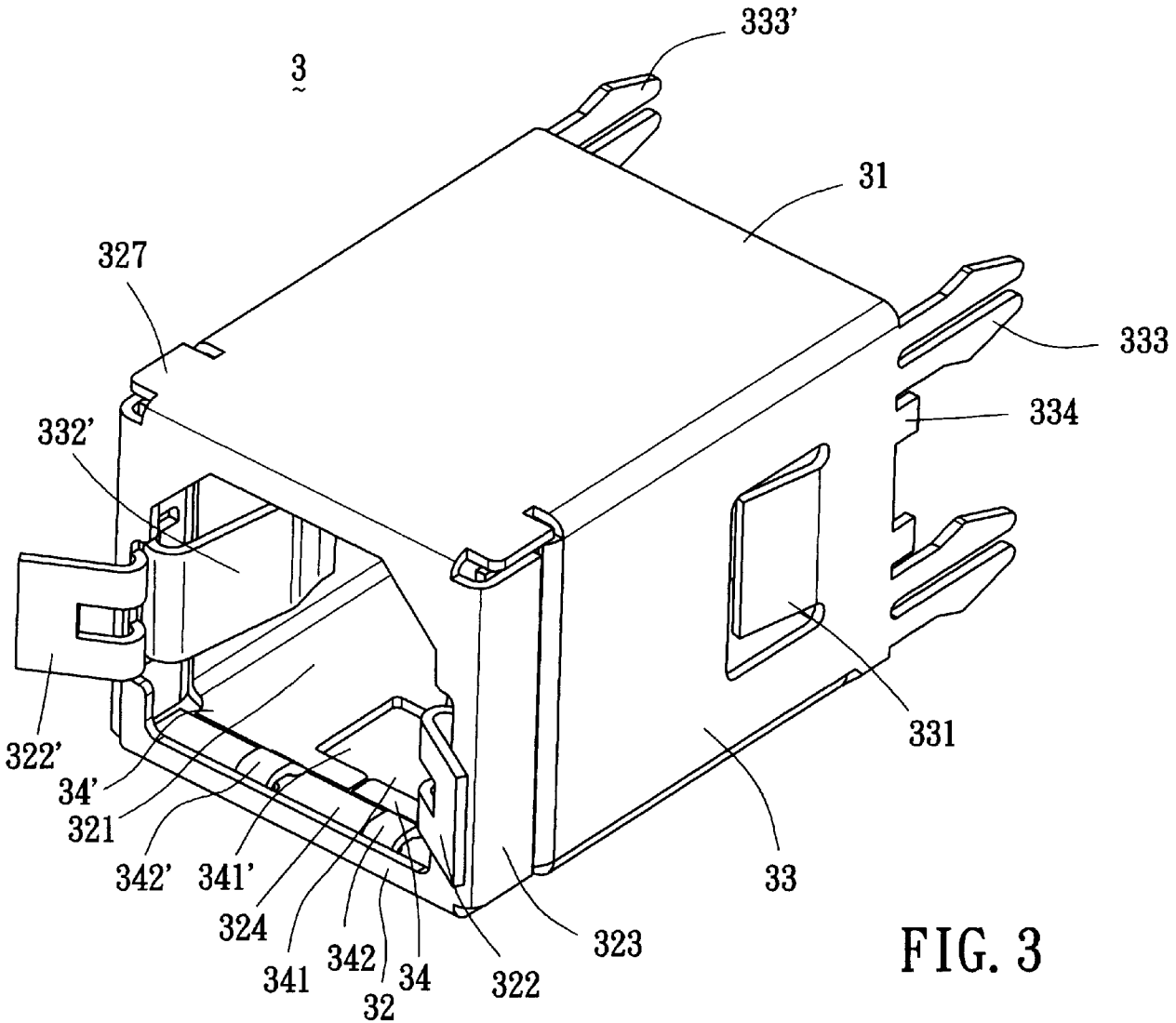
FIG. 3 is a perspective view of a conductive shield constructed in accordance with the present invention.
Figure 4:
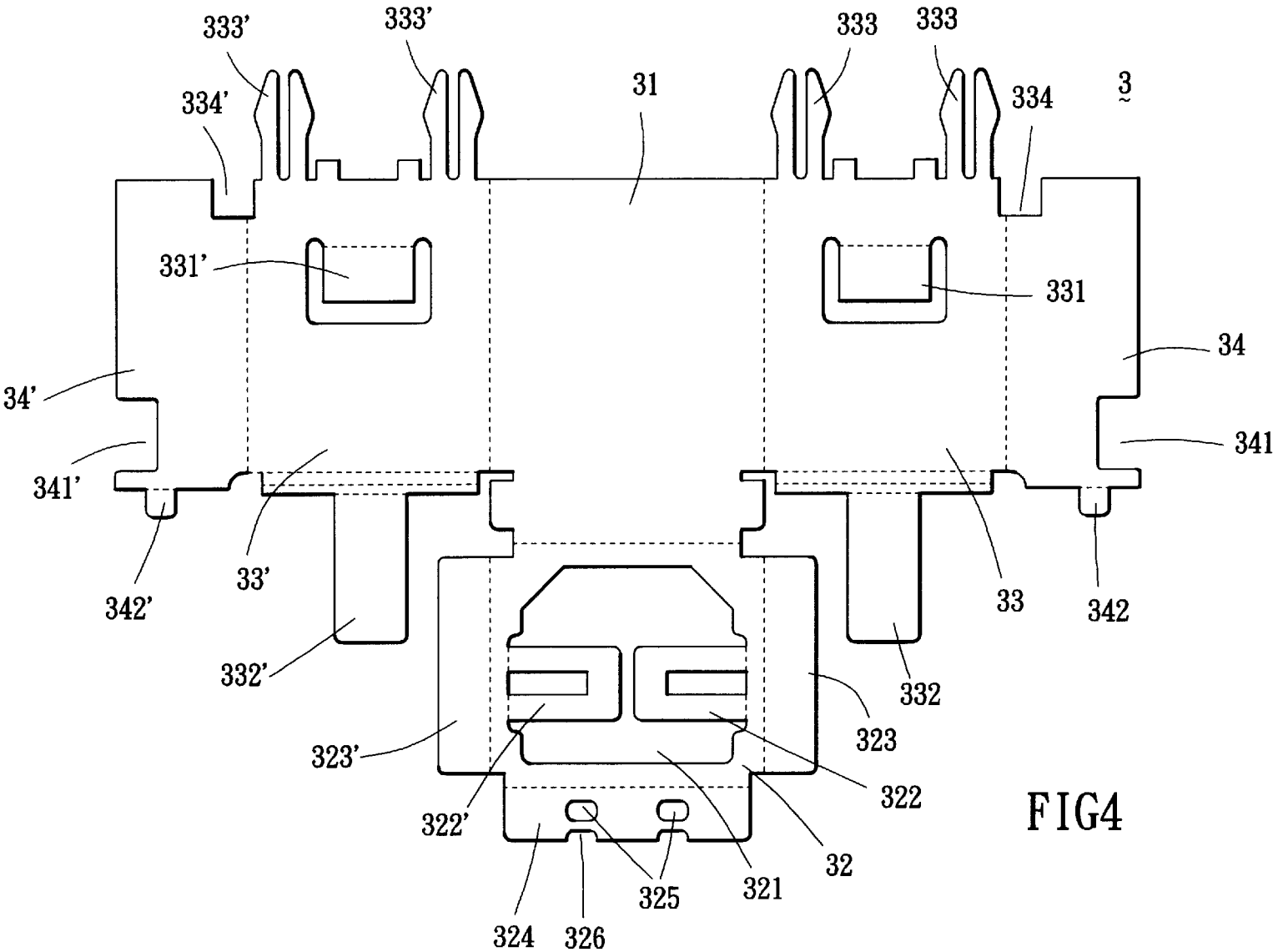
FIG. 4 is a stamped pre-form from which the conductive shield of FIG. 3 is formed.

Referring also to FIGS. 3 and 4, the one-piece conductive shield 3 is bent from a stamped planar pre-form shown in FIG. 4. The shield pre-form has a base section 31, a pair of proximal side sections 33, 33' on two opposite sides of the base section 3 1, a pair of opposite junction sections 34, 34' continuing the pair of side sections 33, 33', and a front face section 32 extending from another side of the base section 31. As FIGS. 1 and 2 clearly show, in assembly, the base section 31 covers the side 17 of the housing 1, the side sections 33 and 33' cover the sides 16 and 18 respectively, the junction sections 34, 34' together cover the side 15, and the front face section 32 which has a hollow central portion 321 covers the front face 11 of the insulative housing 1 while substantially exposing the central cavity 10. Each junction section 34 (or 34') has a hook 342 (or 342') and the face section 32 has a flange 324. The flange 324 has a pair of holes 325 each for lockingly receiving a corresponding hook 342 (or 342') of the junction section 34. To prevent a rearward movement of the insulative housing 1 relative to the conductive shield 3, one or more resilient tabs can be suitably formed on the conductive shield 3 for abutting a respective rear portion 102 of the insulative housing 1. In the embodiment shown, a pair of resilient tabs 331, 331' are formed on the side sections 33, 33', respectively. The resilient tabs 331, 331' may be suitably formed by being struck out of the plane of thickness of side sections 33, 33' to project inwardly and forwardly.

Each side section 33 (or 33') of the conductive shield 3 has a grounding tab 332 rearwardly folded to extend into the cavity 10. Also, the front face section 32 of the conductive shield 3 has a pair of side wings 323, 323' each covering a portion of the side section 33 (or 33') which is proximal to the associated grounding tab 332 (or 332') to serve as a stop for preventing a sideward movement of the side section 33 (or 33') away from the housing 1. Additionally, the front face section 32 of the conductive shield 3 may have a pair of grounding wings 322, 322' bent to extend forwardly and outwardly to contact for example a computer panel (not shown). The side sections 33 are also suitably formed with terminals 333, 333', as is known in this art.

As can be understood from the above description, the shield 3 is separately formed by bending operations and retains its formation mainly by the hooks 342, 342' on the junction sections 34, 34' being latched into the holes 325 on flange 324 of the face section 32. It is noted that the hooks 342, 342' and the pair of holes 325 substantially lie at a same side as defined by the pair of opposite junction sections 34, 34'. Since the flange 324 has a limited width, the latching engagement between the hooks 342, 342' and the holes 325 will be firm and reliable, making it difficult to separate once engaged. The engagement operation between the hooks 342, 342' and the holes 325 are simple in that only a small gripping force applied to bring the pair of side sections 33 toward each other and a small pushing force applied to move the face section 32 toward the side sections 33 is required. A sturdy shield 3 then is obtained. When the shield 3 thus produced is enclosed onto the housing 1, even a forced separation of the opposing junction sections 34, 34' is very difficult, if not impossible. To assist in the engagement of the hooks 342, 342' with the holes 325, an edge of the flange 324 near the hooks 342, 342' is recessed so as to clear from the hooks 342, 342'.

It is noted that the housing 1 shown in this embodiment further comprises a plurality of standoffs raised from the side 15. Namely, a pair of standoffs 152 are disposed at two corners of the side 15 distal from the front face 11 and another pair of standoffs 154 are disposed proximal to the front face 11. The provision of standoffs permit the connector to be mounted to a print circuit board (not shown) with either the rear face 12 or the side 15 facing it. Of course, in this situation, the electrical contacts 2 will be adapted to be either straight or right-angled, as is known in this art. For the present embodiment, the standoffs also aid in properly retaining the junction sections 34, 34' in position. To accommodate the standoffs 152 and 154, each junction section 34 (or 34') of the conductive shield 3 has a first and a second cut-out portions 343 (or 343') for exposing the standoffs. Finally, to permit a smooth mounting of the shield 3 onto the housing 1, each of the pair of standoffs 154 has a slanted upper face. With the hooks 342, 342' latched to the holes 325 and the side wings 323, 323' guarding beside the side sections 33, 33', the resilient property of the junction sections 34, 34' is sufficient to allow the junction sections 34, 34' to return back to their intended position after insertion of the housing 1 within the shield 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having first, second, third, and fourth sides and a front face;

a plurality of contacts secured in the insulative housing; and a one-piece conductive shield having a base section covering the first side, a pair of proximal side sections covering the second and third sides, a pair of opposite junction sections continuing the pair of side sections and covering the fourth side, and a front face section covering the front face of the insulative housing, each junction section having a hook and the face section having a flange, the flange having a pair of holes each for lockingly receiving a corresponding hook of the junction section;

wherein there is a pair of resilient tabs formed on the side sections of the shield, respectively, for abutting a respective rear portion of the insulative housing;

wherein the face section of the conductive shield has a pair of side wings each covering a forward portion of the side section of the shield and an edge of the flange of said face section defines a pair of recesses near the holes of the flange.

* * * * *